US010763602B2

(12) United States Patent
Favero et al.

(10) Patent No.: US 10,763,602 B2
(45) Date of Patent: Sep. 1, 2020

(54) TERMINAL BLOCK, PARTICULARLY FOR THE ELECTRICAL CONNECTION OF PRINTED CIRCUIT BOARDS

(71) Applicant: SAURO S.R.L., Villafranca Padovana (IT)

(72) Inventors: Santino Favero, Padua (IT); Bruno Pagetta, Caselle di Selvazzano (IT); Raffaele Borella, Abano Terme (IT); Nicola Facco, Cadoneghe (IT)

(73) Assignee: SAURO S.R.L., Villafranca Padovana (IT)

( * ) Notice: Subject to any disclaimer, the term of this patent is extended or adjusted under 35 U.S.C. 154(b) by 0 days.

(21) Appl. No.: 16/063,749

(22) PCT Filed: Dec. 20, 2016

(86) PCT No.: PCT/IB2016/057815

§ 371 (c)(1),
(2) Date: Jun. 19, 2018

(87) PCT Pub. No.: WO2017/109691

PCT Pub. Date: Jun. 29, 2017

(65) Prior Publication Data

US 2019/0288417 A1 Sep. 19, 2019

(30) Foreign Application Priority Data

Dec. 21, 2015 (IT) ..... 102015000085537

(51) Int. Cl.
*H01R 12/51* (2011.01)
*H01R 4/48* (2006.01)
(Continued)

(52) U.S. Cl.
CPC ..... *H01R 12/515* (2013.01); *H01R 4/4836* (2013.01); *H01R 9/24* (2013.01); *H01R 13/11* (2013.01); *H01R 12/57* (2013.01)

(58) Field of Classification Search
CPC ..... H01R 13/193; H01R 13/20; H01R 13/11; H01R 4/4818; H01R 4/4827; H01R 4/4836; H01R 12/515; H01R 12/57; H01R 9/24
(Continued)

(56) References Cited

U.S. PATENT DOCUMENTS 6,244,904 B1 * 6/2001 Fabian ..... H01R 4/4836 439/268
6,629,865 B2 * 10/2003 Bungo ..... H01R 13/193 439/268
(Continued)

FOREIGN PATENT DOCUMENTS

EP 2375503 A2 10/2011
EP 2770582 A1 8/2014
(Continued)

OTHER PUBLICATIONS

International Search Report dated Feb. 28, 2017 issued in PCT/IB2016/057815.
(Continued)

*Primary Examiner* — Gary F Paumen
(74) *Attorney, Agent, or Firm* — Scully, Scott, Murphy & Presser. P.C.

(57) ABSTRACT

A terminal block, particularly for the connection of printed circuit boards or "PCB", comprising an enclosure made of insulating material adapted to accommodate at least one electrical cable and grip elements adapted to retain the electrical cable inside the enclosure; the enclosure is adapted to actuate the grip elements for the extraction/insertion of the electrical cable from/in the enclosure.

8 Claims, 3 Drawing Sheets

(51) Int. Cl.
*H01R 9/24* (2006.01)
*H01R 13/11* (2006.01)
*H01R 12/57* (2011.01)

(58) Field of Classification Search
USPC ..... 439/441, 268
See application file for complete search history.

(56) References Cited

U.S. PATENT DOCUMENTS 8,328,586 B2 * 12/2012 Bies ..... H01R 4/4836
439/725
8,968,022 B2 * 3/2015 Mostoller ..... H01R 4/4836
439/438
9,543,682 B2 * 1/2017 Jin ..... H01R 4/4836

FOREIGN PATENT DOCUMENTS

WO WO 2014/160998 A1 10/2014
WO WO 2015/068907 A1 5/2015

OTHER PUBLICATIONS

Italian Search Report and Written Opinion dated Aug. 1, 2016 issued in IT UB20159584, with partial translation.

* cited by examiner

TERMINAL BLOCK, PARTICULARLY FOR THE ELECTRICAL CONNECTION OF PRINTED CIRCUIT BOARDS

The present invention relates to a terminal block, particularly a terminal block for the electrical connection of printed circuits or PCBs.

Terminal blocks are known which allow to connect electrically printed circuit boards, also known as PCB, an acronym of Printed Circuit Board, to electrical cables so as to supply power to the devices that are present on the circuit.

A first type of known terminal block is provided as a body on which a button is added the actuation of which allows the insertion or extraction of an electrical cable. Said button is therefore a component that is external to the terminal block and is often bulky, especially in relation to the context in which the terminal block is used. Moreover, since the button is a separate component with respect to the terminal block, it may accidentally detach from it and be lost.

A further drawback caused by the use of an additional button is due to the need to use an auxiliary device, for example a screwdriver, in order to be able to actuate said button, thus making the wiring operation less convenient.

Other known terminal blocks use elastic hinges provided on the body itself of said terminal block.

In any case, the pivoted part of the terminal block is extremely fragile and often subject to breakage after a small number of actuations.

The aim of the present invention is to overcome the limitations of the background art described above, proposing a terminal block that is capable of being stronger, relatively modest in size and easy to use.

Within this aim, an object of the present invention is to provide a terminal block such as to simplify the insertion of the electrical cables, preventing their unwanted removal.

Another object of the present invention is to provide a terminal block that is adapted to allow wiring without resorting to tools that are external to the terminal block, such as for example a screwdriver.

Another object of the present invention is to provide a terminal block that has a simple structure, is relatively easy to provide in practice, is safe in use and effective in operation, and has a relatively modest cost.

This aim and these and other objects that will become better apparent hereinafter are achieved by a terminal block according to claim 1 and by an assembly according to claim 8.

Advantageously, the terminal block can be used on PCB printed circuit boards.

Conveniently, the terminal block is resistant to mechanical stresses.

Further characteristics and advantages of the invention will become better apparent from the detailed description that follows, given by way of nonlimiting example and accompanied by the corresponding figures, wherein.

Figure 1:
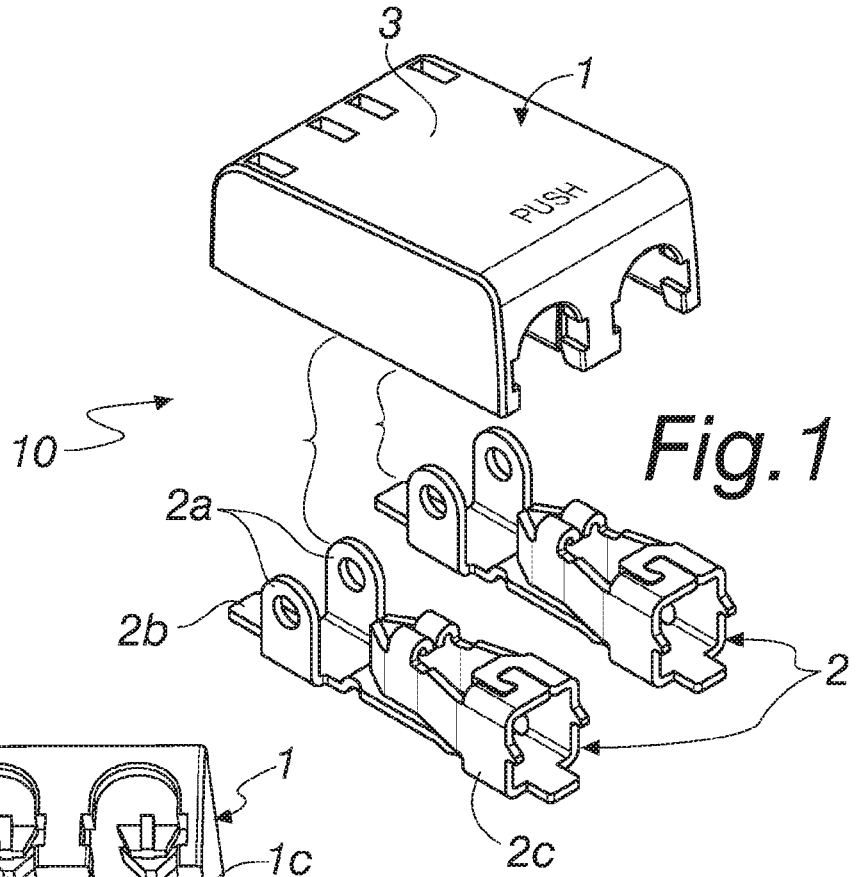
FIG. 1 is an exploded perspective view of the terminal block according to the present invention.
Figure 2:
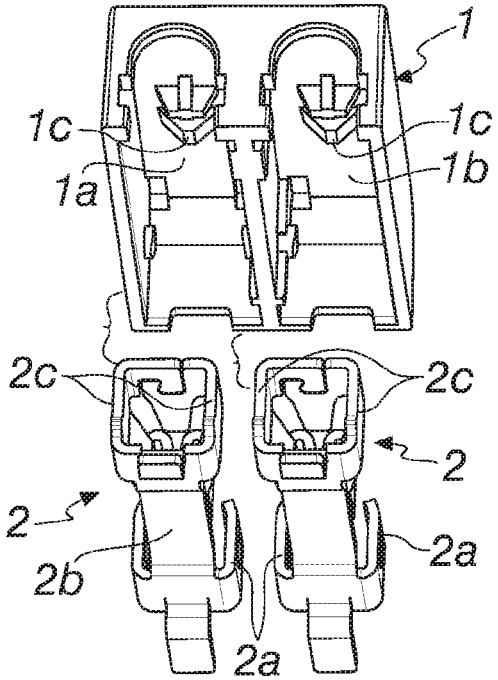
FIG. 2 is another exploded perspective view of the terminal block according to the invention.
Figure 3:
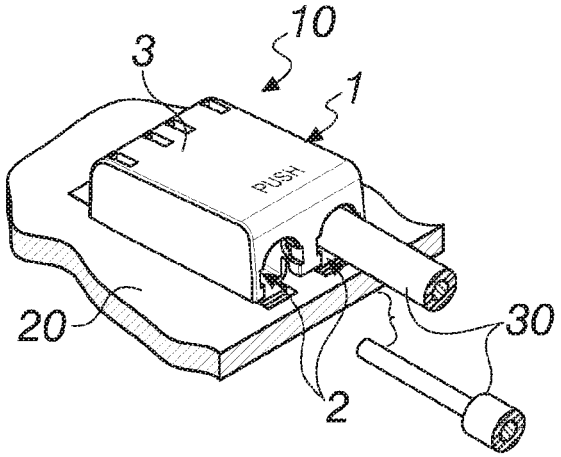
FIG. 3 is a perspective view of the terminal block according to the present invention.

An exemplifying architecture that is the subject-matter of the present invention is summarized in the exploded perspective view of FIG. 1, in which the terminal block is designated generally by the reference numeral 10.

The terminal block 10 comprises an enclosure 1 and grip means 2.

The enclosure 1 is made of insulating material, for example plastic, and is adapted to accommodate at least one electrical cable 30.

The enclosure 1 is provided with a plurality of cavities that are shaped to receive an electrical cable 30 each.

In the figures, the enclosure 1 has a configuration that comprises two cavities 1*a* and 1*b*, which allow the insertion of two corresponding electrical cables 30, but it should be understood that their number can vary according to the specific requirements.

In any case, each one of said cavities is adapted to accommodate an electrical cable 30 and the grip means 2.

The enclosure 1 has an external surface, of an elastically deformable upper portion 3, on which it is possible to apply, for example by means of a finger, a pressure that is perpendicular to the longitudinal extension of the terminal block 10.

On the inner side of the enclosure 1 there is, for each cavity 1*a* and 1*b* and therefore for each one of the grip means 2, a protrusion 1*c* that is configured to abut against the grip means 2.

In particular, the protrusion 1*c* is adapted to transmit mechanically the pressure applied to the outer surface of the enclosure 1 to the grip means 2 and cause their deactivation.

In other words, as a function of the presence of a sufficient pressure on the outer surface of the enclosure 1, the grip means 2 are deactivated, allowing the insertion or extraction of an electrical cable 30 within a cavity of the enclosure 1.

If the pressure is not present or in any case does not have a sufficient value, the grip means 2 are activated and retain, if present, an electrical cable inside the cavity or, if not present, prevent its insertion.

The protrusion 1*c* is formed integrally with the enclosure 1, i.e., is monolithic with the enclosure 1.

Advantageously, since the enclosure 1 is a monolithic body, it is stronger than bodies that have separate parts or parts that are subjected to mechanical stress, such as folds.

The grip means 2 are adapted to retain an electrical cable 30 within a cavity of the enclosure 1 and, if actuated by the enclosure 1, to allow the release of the electrical cable 30. In the preferred embodiment, the grip means 2 comprise a body that is configured to be arranged in a cavity of the enclosure 1. The body is provided with a base 2*b* which is adapted to support at least partially an electrical cable 30 and to be interposed between the electrical cable 30 and a printed circuit board 20 (PCB) on which the terminal block 10 can be fixed.

In particular, the base 2*b* can be welded to the board 30. The body of the grip means 2 further comprises two portions 2*a* which are perpendicular to the base 2*b* for fixing to the enclosure 1.

Finally, the body of the grip means 2 comprises an elastic component, which can be provided like the structure of a spring and is adapted to block an electrical cable 30, allowing its removal only if appropriately actuated by a respective protrusion 1*a*.

In particular, the elastic component comprises two portions 2*c*, which are divaricated from a respective protrusion 1*c* in order to allow access or extraction of the cable 30. Preferably, these two portions 2*c* are mirror-symmetrical and have a substantially V-shaped configuration.

Operation of the terminal block 10 according to the present invention is as follows.

First of all, the terminal block 10 is arranged, for example by welding, on a printed circuit board 20.

Figure 4:
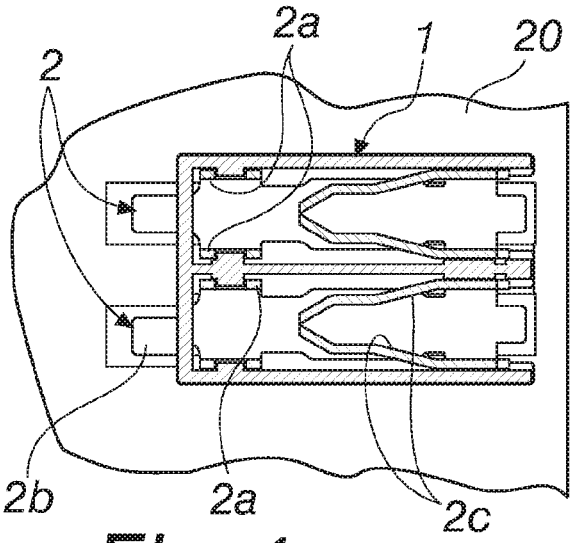
FIG. 4 is a sectional top view of the terminal block according to the present invention in a first configuration for use.
Figure 5:
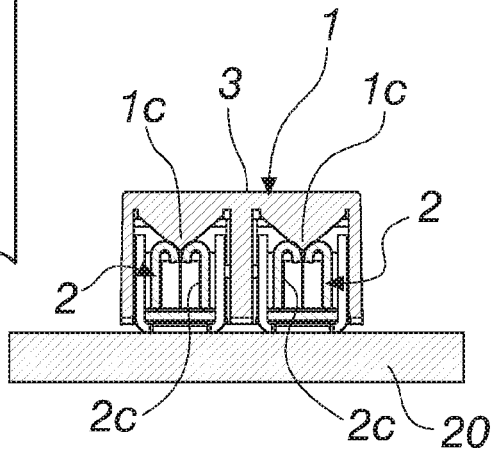
FIG. 5 is a transverse sectional view of the terminal block according to the present invention in the first configuration for use.
Figure 6:
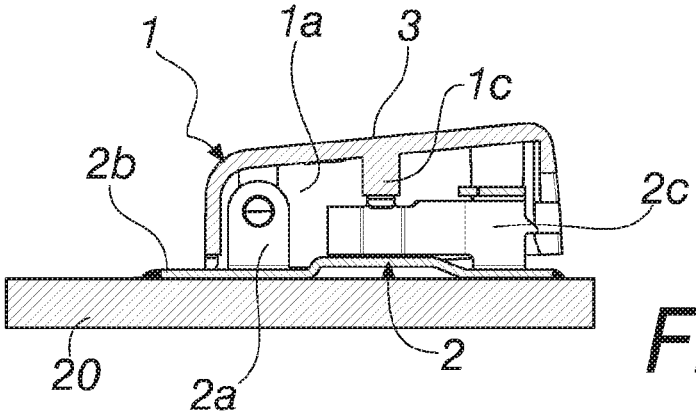
FIG. 6 is a longitudinal sectional view of the terminal block according to the present invention in the first configuration for use.

In this condition, the terminal block 10 is in the first configuration for use, i.e., inactive, shown in FIGS. 4 and 5, in which the two portions 2*c* are not divaricated.

Figure 7:
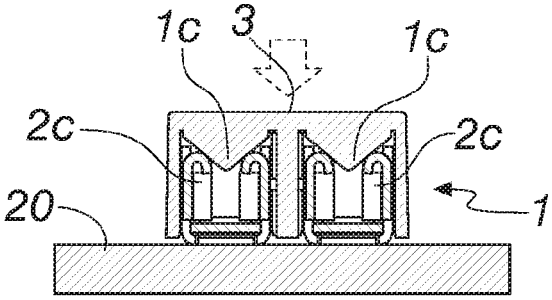
FIG. 7 is a transverse sectional view of the terminal block according to the present invention in a second configuration for use.
Figure 8:
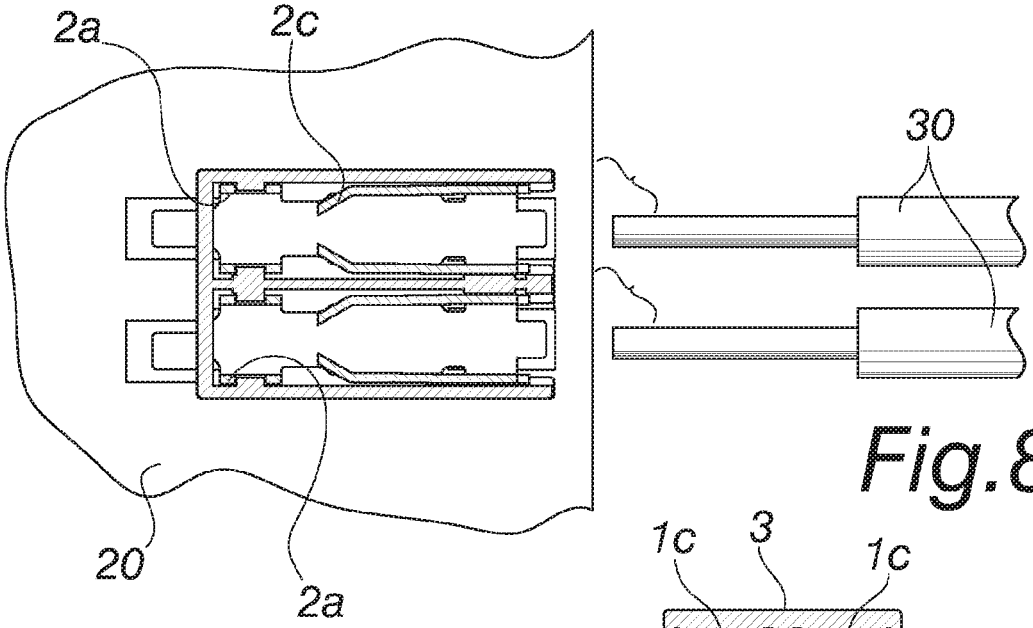
FIG. 8 is a partially sectional top view of the terminal block according to the present invention in the second configuration for use.
Figure 9:
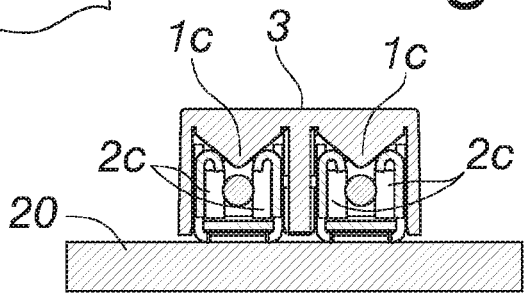
FIG. 9 is a transverse sectional view of the terminal block according to the present invention in a third configuration for use.
Figure 10:
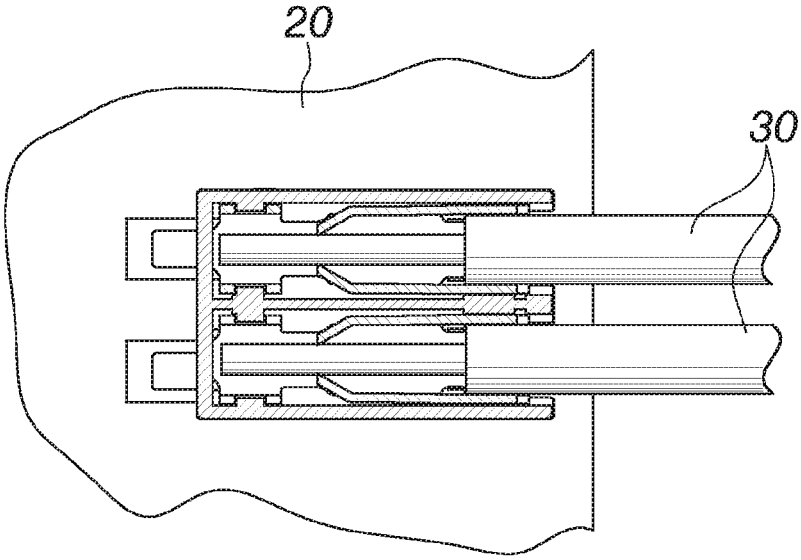
FIG. 10 is a partially sectional top view of the terminal block according to the present invention in the third configuration for use.

As a consequence of a pressure applied to the enclosure 1, as indicated by the arrows in FIGS. 9 and 10, the two portions 2*c* are divaricated by a respective protrusion 1*c*, as shown in FIG. 7.

An electrical cable 30 is then inserted.

When the pressure stops being applied to the enclosure 1, the two portions 2*c* close, clamping the inserted cable 30, as shown in FIGS. 10 and 11.

If the cable 30 has to be removed, it is sufficient to apply again a pressure to the enclosure 1, causing the divarication of the components 2*c* and therefore the extraction of the cable 30.

It has thus been shown that the method and system described achieve the intended aim and objects.

In particular, it has been shown that the terminal block 10 thus conceived allows to overcome the qualitative limitations of the background art by means of an enclosure 1 that has the function of an actuation button and which, by cooperating with the grip means 2, allows fast and effective wiring.

Numerous modifications are clearly evident and can be promptly performed by the person skilled in the art without abandoning the protective scope of the present invention.

For example, the system for mechanical coupling between the grip means 2 and the enclosure 1 can be provided in different manners, for example by means of pins or by vertical sliding.

Furthermore, the terminal block can be adapted easily so that it is integrated in various connection devices.

Therefore, the scope of the protection of the claims must not be limited by the illustrations or preferred embodiments shown in the description by way of examples, but rather the claims must comprise all the characteristics of patentable novelty that reside in the present invention, including all the characteristics that would be treated as equivalents by the person skilled in the art.

The disclosures in Italian Patent Application no. 102015000085537 (UB2015A009584), from which this application claims priority, are incorporated herein by reference.

The invention claimed is:

1. A terminal block, particularly for the electrical connection of printed circuit boards, comprising an enclosure made of insulating material adapted to accommodate at least one electrical cable, and grip means adapted to retain said at least one electrical cable inside said enclosure;

wherein said enclosure comprises a first side, a second side opposing the first side, and an external surface, wherein the first side and the second side are both perpendicular to the external surface, wherein the external surface extends from the first side to the second side, wherein said enclosure is a monolithic body, and wherein said enclosure comprises at least opening, wherein the at least one opening is adapted to allow said at least one electrical cable to pass into said enclosure, wherein the external surface is adapted to receive a pressure, and on an inner side of said enclosure that corresponds to said external surface there being at least one protrusion, which protrudes from said enclosure and is adapted to abut against said grip means;

wherein said external surface is configured to elastically deform and transmit, through the protrusion, the pressure applied to said external surface to said grip means, wherein the protrusion is adapted to deactivate said grip means; the deactivation of said grip means allowing the insertion or release of one or more said electrical cables in or from said enclosure.

2. The terminal block according to claim 1, wherein said grip means are of the elastic type and are configured to retain one end of said at least one electrical cable.

3. The terminal block according to claim 1, wherein said enclosure has a plurality of cavities that can be accessed from outside and are each adapted to accommodate said at least one electrical cable and said grip means.

4. The terminal block according to claim 1, wherein said grip means can be fixed to said enclosure.

5. The terminal block according to claim 1, wherein said grip means comprises a body, said body having: a base adapted to support said at least one electrical cable; at least two portions that are perpendicular to said base for fixing said body to said enclosure, and an elastic component comprising two portions adapted to cooperate in order to retain said electrical cable.

6. The terminal block according to claim 5, wherein said elastic component is configured to be divaricated by the at least one protrusion.

7. The terminal block according to claim 1, further comprising a system for coupling said enclosure to said grip means.

8. An assembly comprising a terminal block according to claim 1, at least one printed circuit board on which said terminal block is applied, and at least one electrical cable inserted in said terminal block and adapted to supply power to said printed circuit board.

* * * * *